United States Patent [19]

Tomiyama

[11] Patent Number: 4,916,044

[45] Date of Patent: Apr. 10, 1990

[54] COLOR DIFFUSION TRANSFER ELEMENT WITH AUXILLARY NEUTRALIZING LAYER COMPRISING CELLULOSE ACETATE

[75] Inventor: Hideki Tomiyama, Kanagawa, Japan

[73] Assignee: Fuji Photo Film Co., Ltd., Kanagawa, Japan

[21] Appl. No.: 139,235

[22] Filed: Dec. 29, 1987

[30] Foreign Application Priority Data

Dec. 29, 1986 [JP] Japan ..... 61-315539

[51] Int. Cl.[4] ..... G03C 5/54; G03C 7/00

[52] U.S. Cl. ..... 430/216; 430/454; 430/463; 428/507; 428/514; 428/532

[58] Field of Search ..... 430/216, 454, 463; 428/507, 514, 532

[56] References Cited

U.S. PATENT DOCUMENTS

| | | | |
|---|---|---|---|
| 3,362,819 | 1/1968 | Land | 430/216 |
| 3,734,727 | 5/1973 | Milligan | 430/216 |
| 4,356,249 | 10/1982 | Abel et al. | 430/216 |
| 4,551,410 | 11/1985 | Tomiyama et al. | 430/216 |

OTHER PUBLICATIONS

"Neutralizing Materials in Photographic Elements", *Research Disclosure,* No. 12337, 7/1974, pp. 22–24.

*Primary Examiner*—Richard L. Schilling
*Attorney, Agent, or Firm*—Sughrue, Mion, Zinn, Macpeak & Seas

[57] ABSTRACT

A color photographic element for use in color diffusion transfer photography comprised of a lightsensitive dye release and receiving sheet and a cover sheet, wherein development, dye release and dye transfer occur in the presence of an alkaline processing solution, and wherein the cover sheet is provided with a neutralizing system which causes neutralization by an alkaline processing solution to proceed by at least a first and a second stage, wherein the first stage is characterized in that neutralization (lowering) of the pH of an alkaline processing solution occurs to the extent to interrupt development and dye release reactions but at which the transfer of a dye for forming a transfer image can continue, and a second stage at which the pH of the processing solution is gradually lowered to a final value which is stably maintained over prolonged storage, the photographic element characterized in that the neutralizing system comprises at least a neutralizing layer, a 2nd neutralization timing layer, an auxiliary neutralizing layer, and a 1st neutralization timing layer as viewed from the support side, and that said auxiliary neutralizing layer contains 5 to 60% by weight of a cellulose acetate having an acetylation degree of 40 to 60.

14 Claims, No Drawings

COLOR DIFFUSION TRANSFER ELEMENT WITH AUXILLARY NEUTRALIZING LAYER COMPRISING CELLULOSE ACETATE

FIELD OF THE INVENTION

The present invention relates to a photographic element for use in color diffusion photogrpahy. Particularly, the present invention relates to a photographic element for color diffusion transfer process (DTR) in which the processing solution neutralizing process in a neutralizing system proceeds by two stages. More particularly, the present invention relates to a color diffusion transfer photographic element which provides improved sharpness, aftertransfer characteristics, and image preservability.

BACKGROUND OF THE INVENTION

In an ordinary photographic or diffusion transfer process, it is known that a temporary barrier layer may be provided between layers in a photographic element into which a processing solution penetrates. Particularly in the diffusion transfer photographic process, a neutralizing layer may be used for the purpose of stopping development, stabilizing the image, or like purposes. It is also well known in the art that a temporary barrier layer may be used for the purpose of "timing" the neutralization to prevent the neutralization of a developing solution by the neutralizing layer from proceeding earlier than required and hence prevent the reduction of the maximum density. Such a temporary barrier layer used for this purpose is called a timing layer. Examples of such a timing layer are disclosed in U.S. Pat. Nos. 4,061,496, 4,056,394, and 4,201,587, and Japanese Patent Application (OPI) Nos. 72622/78 (corresponding to U.S. Pat. No. 4,199,362), and 141644/82 (the term "OPI" as used herein means an "unexamined published application").

In general, the development reaction in a silver halide photographic process proceeds slowly at a low temperature but more rapidly at an elevated temperature. Therefore, if the diffusion transfer process is used for instant photography where development is conducted at various temperatures, unlike ordinary photography where development is conducted at a controlled temperature, it is extremely important to impart to the photographic element a function of compensating for development speed by causing the neutralization reaction of the processing solution to depend on the temperature by accelerating the neutralization reaction at an elevated temperature or slowing the neutralization reaction at a low temperature in order to obtain a consistently excellent image regardless of change in development temperature. The above listed patents discribe many examples of timing layers having such a temperature compensation effect.

A so-called monosheet type diffusion transfer photographic process is subject to a problem of a rise in the color density over the maximum density portion, gradation portion, and minimum density portion with the passage of time (several days to weeks) after the formation of an image. This is a phenomenon called "aftertransfer" which remarkably deteriorates the picture quality. In this phenomenon, a dye released during the processing step is not entirely allowed to migrate to a mordant layer, and part of the dye is left in layers other than the mordant layer. The dye left in the other layers gradually migrate into the mordant layer with the passage of time. The cover sheet containing a timing layer as described in the above cited patents has virtually no effect on inhibiting such an aftertransfer phenomenon. Even if the cover sheet has somewhat of an effect, there is an attendant disadvantage in that the sharpness of the transfer image is deteriorated.

Japanese Patent Application (OPI) No. 19137/85 made it possible to inhibit aftertransfer without deteriorating sharpness by using a photographic element. Particularly, in a color diffusion transfer photographic element containing a neutralizing system for lowering the pH of an alkaline processing solution, the processing solution neutralizing process in the neutralizing system is divided into two stages. This neutralizing system comprises a neutralizing layer and a timing layer. This timing layer is directly or indirectly laminated on or under the neutralizing layer in such a positional relationship that alkaline processing solution reaches the neutralizing layer via the timing layer. Different neutralizing processes proceed at the two stages. More particularly, the photographic element disclosed in Japanese Patent Application (OPI) No. 19137/85 is characterized by the neutralization process which proceeds by at least two stages such that in the first stage the development and dye release reaction is interrupted due to the lowering of the pH of the processing solution (photographic system) while at the same time the transfer of a dye for forming a transfer image can still continue, and in the second stage of pH of the processing solution (photographic system) is gradually lowered to a final value at which dye transfer is also inhibited and which is capable of withstanding prolonged storage, as a result of which the dye remains immobilized and the image remains stable. One such neutralizing process is characterized by a rapid pH change. This is a so-called "inverted S-shaped" pH drop process in which pH is maintained at a high value for some period of time, and then shows a rapid drop. Another neutralizing process is characterized by a relatively slow pH drop. However, the latter process may also be an inverted S-shaped pH drop process. Such a twostage neutralizing process can be accomplished by sequentially coating on a support a neutralizing layer, a 2nd timing layer, an auxiliary neutralizing layer, and a 1st timing layer to provide a neutralizing system layer. Or by using a neutralizing layer which makes a gradual neutralization, such a two stage neutralizing process can also be accomplished by sequentially coating on a support a neutralizing layer, an auxiliary neutratizing layer, and a 1st timing layer, without using a 2nd timing layer.

Such a pH drop process (mode) can be freely controlled particularly by adjusing the component, composition and coated amount of the above described timing layer. That is, the duration (x) during which pH is maintained high can be controlled by the first timing layer, the pH drop at the first stage can be controlled by the auxiliary neutralizing layer, and the pH drop process after the period x can be controlled by the second timing layer and the neutralizing layer. Aftertransfer can be effectively controlled by properly controlling this neutralizing process. The greater the temperature coefficient of the 1st timing layer is, i.e., the lower the temperature the longer timing provides the 1st timing layer. In other words, the timing layer preferably has an effect of retarding neutralization.

On the other hand, U.S. Pat. No. 4,356,249 describes an improvement in the processing temperature dependence of a color diffusion transfer photographic film unit (assemblage) containing a positive type redox compound as a dye image forming compound. In accordance with this U.S. patent, this improvement can be accomplished by providing two layers, i.e. a 1st timing layer and a 2nd timing layer, and further providing two neutralizing layers, i.e. a conventional neutralizing layer and an auxiliary neutralizing layer between the 1st timing layer and the 2nd timing layer. (The first timing layer has a negative temperature coefficient.) In such a photographic system, the auxiliary neutralizing layer is designed to inhibit the release of a dye from a positive type redox compound involved in the development of silver halide more at a low temperature than at an elevated temperature in order to improve the processing temperature dependence thereof. Thus, this photographic system is not intended to prevent aftertransfer of a diffusive dye released from a positive type redox compound. Therefore, this photographic system cannot provide an effect of preventing aftertransfer.

When stored at a high temperature and high humidity, the image formed by processing may be gradually discolored even in a dark place, causing a remarkable deterioration of the picture quality. Particularly, a magenta dye image is susceptible to such a discoloration due to its structure. On the other hand, the above described aftertransfer causes color intensification. Actually, such color intensification and discoloration compensate each other and thus cannot be noticeably observed. However, if the neutralizing system disclosed in Japanese Patent Application (OPI) No. 19137/85 is used to inhibit aftertransfer, discoloration is noticeably observed rather than color intensification. Therefore, if such a neutralizing system is stored at a high temperature and a high humidity, the picture quality is deteriorated.

Accordingly, if this neutralizing system could be improved in the image preservability, a complete system free of both color intensification and discoloration can be obtained.

SUMMARY OF THE INVENTION

It is therefore an object of the present invention to provide a color diffusion transfer photographic element, particularly an integrated color diffusion transfer photographic element, which can provide improved sharpness and aftertransfer characteristics and an excellent image preservability.

The above and other objects of the present invention will become more apparent from the following detailed description and examples.

These objects of the present invention are accomplished with a color diffusion transfer photographic element comprised of a light-sensitive dye release and receiving sheet and a cover sheet, wherein development, dye release and dye transfer occur in the presence of an alkaline processing solution, and wherein the cover sheet is provided with a neutralizing system which cause neutralization by an alkaline processing solution to proceed by at least a first and a second stage, wherein the first stage is characterized in that neutralization (lowering) of the pH of an alkaline processing solution occurs to the extent to interrupt development and dye release reactions but at which the transfer of a dye for forming a transfer image can continue, and a second stage at which the pH of the processing solution is gradually lowered to a final value which is stably maintained over prolonged storage, the photographic element characterized in that the neutralizing system comprises at least a neutralizing layer, a 2nd neutralization timing layer, an auxiliary neutralizing layer, and a 1st neutralization timing layer as viewed from the support side, and that said auxiliary neutralizing layer contains 5 to 60% weight of a cellulose acetate having an acetylation degree of 40 to 60.

DETAILED DESCRIPTION OF THE INVENTION

The acetylation degree of the cellulose acetate to be added to the auxiliary neutralizing layer in the present invention is preferably in the range of 40 to 60, preferably 50 to 56. (An acetylation degree of 50 to 56 means that hydrolysis of 100 g of a cellulose acetate produces 50 to 56 g of acetic acid.)

Such an auxiliary neutralizing layer may further comprise an additional acidic material. Such an acidic material preferably has a good compatibility with the above described cellulose acetate or is at least optically close to the above described cellulose acetate in refractive index. Furthermore, such an acidic material preferably is soluble in a common solvent with the cellulose acetate to facilitate the coating of the layer on a support.

As a suitable acidic material there can be used a material containing an acidic group of a pKa of 9 or less (or a precursor group providing such an acidic group upon hydrolysis). Specific examples of such an acidic material include higher aliphatic acids such as oleic acid as described in U.S. Pat. No. 2,983,606, polymers of acrylic acid, methacrylic acid, or maleic acid, copolymers of these acids with other monomers (such as methyl vinyl ether, styrene, ethylene, vinyl acetate), or partial esters or acid anhydrides thereof as disclosed in U.S. Pat. No. 3,362,819, copolymers of acrylic acid with acrylic ester as disclosed in French Pat. No. 2,290,699, and latex type acidic polymers as disclosed in U.S. Pat. No. 4,139,383, and *Research Disclosure* No. 16102 (1977).

Other suitable examples of such an acidic material include acidic materials as disclosed in U.S. Pat. No. 4,088,493, and Japanese Patent Application (OPI) Nos. 153739/77, 1023/78, 4540/78, 4541/78, and 4542/78.

Specific examples of such acidic polymers include copolymers of vinyl monomers such as ethylene, vinyl acetate, and methyl vinyl ether with maleic anhydride or n-butyl half esters thereof, copolymers of butyl acrylate with acrylic acid, and cellulose acetate hydrogen phthalate.

The proportion of the above described cellulose acetate in the auxliary neutralizing layer is preferbly 5 to 60% by weight, more preferably 10 to 60% by weight based on the total weight of polymer in the auxiliary neutralizing layer. The amount of the auxiliary neutralizing layer to be coated can be properly selected by considering the composition of the alkaline processing solution to be neutralized, and the type and amount of the acidic material to be used, but is preferably in the range of 0.5 to 5 g/m$^2$.

The neutralizing layer in the neutralizing system of the present invention may comprise an acidic material. As such an acidic material there can be used a known acidic material which is not specificially limited. As a suitable acidic material there can be used a material containing an acidic group of a pKa of 9 or less (or a precursor group providing such an acidic group upon hydrolysis). Specific examples of such an acidic material include higher aliphatic acids such as oleic acid as described in U.S. Pat. No. 2,983,606, polymers of acrylic acid, methacrylic acid, or maleic acid, copolymers of these acids with other monomers (such as methyl vinyl ether, styrene, ethylene, vinyl acetate), or partial esters or acid anhydrides thereof as disclosed in U.S. Pat. No. 3,362,819, copolymers of acrylic acid with acrylic ester as disclosed in French Pat. No. 2,290,699, and latex type acidic polymers as disclosed in U.S. Pat. No. 4,139,383, and *Research Disclosure* No. 16102 (1977).

Other suitable examples of such an acidic material include acidic material as disclosed in U.S. Pat. No. 4,088,493, and Japanese Patent Application (OPI) Nos. 153739/78, 1023/78, 4540/78, 4541/78, and 4542/78.

Specific examples of such acidic polymers include copolymers of vinyl monomers such as ethylene, vinyl acetate, and methyl vinyl ether with maleic anhydride or n-butyl half esters thereof, copolymers of butyl acrylate with acrylic acid, and cellulose acetate hydrogen phthalate.

The polymer to be used in the 1st and 2nd neutralization timing layers may be either a latex polymer or a solvent-soluble polymer. Such a polymer may be either a homopolymer or copolymer, and is preferably copolymer.

Examples of useful polymers include polymers which render the neutralization timing layers low in permeability to alkali, such as gelatin, polyvinyl alcohol, a partial acetal compound of polyvinyl alcohol, a cellulose derivative (e.g. cellulose acetate), and partially hydrolyzed polyvinyl acetate, latex polymers which have been prepared by copolymerization of a small amount of a hydrophilic comonomer such as an acrylic monomer so as to raise the activation energy of permeation of alkali, and polymers containing a lactone ring.

Preferred examples of such a polymer inlcude cellulose acetates as disclosed in Japanese Patent Application (OPI) No. 13628/79, and U.S. Pat. Nos. 4,267,262, 4,009,030, and 4,029,849, latex polymers prepared by copolymerization of a small amount of a hydrophilic comonomer such as acrylic acid as disclosed in Japanese Patent Application (OPI) Nos. 128335/79, 69629/81, and 6843/82, and U.S. Pat. Nos. 4,056,394, 4,061,496, 4,199,362, 4,250,243, 4,256,827, and 4,268,604, polymers containing a lactone ring as disclosed in U.S. Pat. No. 4,229,516, and polymers as disclosed in Japanese Patent Application (OPI) Nos. 25735/81, 97346/81, and 6842/82, and European Pat. No. 31,957A1, 37,724A1, and 48,412A1.

There may be also used polymers as described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, West German Patent Application (OLS) Nos. 1,622,936, and 2,162,277, *Research Disclosure* No. 15162, (1976), and Japanese Patent Application (OPI) No. 202463/84.

These polymers for the 1st and 2nd neutralization timing layers can be used singly or in combination. These polymers can be used in combination with polymers as described in Japanese Patent Application (OPI) Nos. 130926/79, 54341/80, 25735/81, 173834/82, and 179841/82, U.S. Pat. Nos. 4,029,849, 4,267,262, and 4,229,516, and European Pat. No. 9795A2.

Specific examples of polymers as described in these patents include vinylidene chloride copolymer, conjugate diene copolymer, and maleic copolymer.

If these polymers and used in admixture, their mixing ratio can be properly selected and is not specifically limited.

The 1st and 2nd timing layers may each comprise a combination of two or more layers so long as they comprise the above described polymers.

The auxiliary neutralizing layer, 1st timing layer and 2nd timing layer may contain a development inhibitor and/or precursor thereof as disclosed in U.S. Pat. No. 4,009,029, West German Patent Application (OLS) Nos. 2,913,164, and 3,014,672, and Japanese Patent Application (OPI) Nos. 155837/79, 138745/80, 139365/80, 105640/84, 105641/84, and 105642/84, a hydroquinone precursor as disclosed in U.S. Pat. No. 4,201,578, or other photographic additives or precursors thereof incorporated therein.

The photographic element of the present invention may be a light-sensitive material comprising a neutralizing system, a cover sheet comprising a neutralizing system laminated on a light-sensitve material, or an image-receiving material comprising a neutralizing system. Alternatively, the photographic element may be an integrated body of an image-receiving element, a light-sensitive element, a cover sheet comprising a neutralizing system, and a processing element, or an integrated body of an image-receiving element comprising a neutralizing system, a light-sensitive element, and a processing element. Such a photographic element comprising an integrated film unit may be optionally such that such elements are peeled off after processing.

In the reproduction of natural colors by the subtractive process, a light-sensitive material comprising at least two combinations of a silver halide emulsion having a selective spectral sensitivity in a certain wavelenght region and a dye-image forming compound (hereinafter referred to as "coloring material") having a selective spectral absorption in the same wavelength region (or a coloring material containing a group capable of forming such a dye) may be used.

If the photographic element of the present invention is a light-sensitive material or a film unit, it advantageously comprises a light-sensitive element containing a combination of a blue-sensitive silver halide emulsion and a yellow coloring material, a combination of a green-sensitive emulsion and a magenta coloring material, and a combination of a red-sensitive emulsion and a cyan coloring material. In such a combination unit, these emulsions and coloring materials may be superimposed on each other in face-to-face relation in layers in the light-sensitive material. Alternatively, these coloring materials and emulsions may be mixed in particulate form and coated as one layer. (That is, the coloring material and the particulate silver halide exist in the same particle.)

The present invention will be further illustrated in the following example of a coloring material which releases a diffusive dye for forming a transfer image.

A coloring material which can be preferably used in the present invention is a DRR (Dye-Releasing Redox) compound which is substantially immoble under an alkaline processing condition and can be represented by the following equation:

(Ballast)-(Redox cleavage atomic group)-(Dye)

wherein (Ballast) is a group which serves to immobilize the DRR compound under an alkaline processing condition. If the DDR compound is substantially immoble only due to (Redox cleavage atomic group)(Dye), (Ballast) is not needed. (Dye) is a dye group or precursor thereof which can migrate in the light-sensitive element at least under an alkaline processing condition upon separation from the compound. (Redox cleavage atomic group) is subject to cleavage by oxidation or reduction under an alkaline condition.

Examples of such a redox cleavage atomic group are described in U.S. Published Patent Application B 351,673, U.S. Pat. Nos. 3,928,312, 4,055,428, 4,053,312, 4,336,322, 3,443,930, 3,443,939, 3,628,952, 3,844,785, 3,443,943, 3,980,479, 4,278,750, 4,278,750, 4,139,379, 4,218,368, 4,183,753, 4,142,891, 3,421,964, and 4,199,355, and Japanese Patent Application (OPI) Nos. 50736/78, 104343/76, 46730/78, 130122/79, and 110827/78. The dye released from the coloring material used in the present invention may be an existing dye or a dye precursor which can be converted to a dye at the photographic processing step or additional processing step. The final image dye may optionally be a metal complex. Typical examples of dye structure of coloring materials useful in the present invention include azo dyes, azomethine dyes, anthraquinone dyes, and phthalocyanine dyes which may optionally be metal-complexed. Particularly preferred among these dyes are cyan, magenta and yellow dyes.

Specific examples of such yellow dyes are described in U.S. Pat. Nos. 3,597,200, 3,309,199, 4,013,633, 4,245,028, 4,156,609, 4,139,383, 4,195,992, 4,148,641, and 4,148,643, Japanese Patent Application (OPI) Nos. 114930/76, 16130/81, and 71072/81, and *Research Disclosure* Nos. 17630 (1978), and 16475 (1977).

Specific examples of such magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and Japanese Patent Application (OPI) Nos. 106727/77, 23628/78, 36804/80, 73057/81, 71060/81, and 134/80.

Specific examples of such cyan dyes are described in U.S. Pat. Nos. 3,482,972, 3,929,760, 4,013,635, 4,268,625, 4,171,220, 4,242,435, 4,142,891, 4,195,994, 4,147,544, and 4,148,642, British Pat. No. 1,551,138, Japanese Patent Application (OPI) Nos. 99431/79, 8827/77, 47823/78, 143323/78, 99431/79, and 71061/81, European Pat. Nos. 53,037, and 53,040, and *Research Disclosure* Nos. 17630 (1978), and 16475 (1977).

An example of such a useful dye precursor is a dye precursor containing a dye portion which has been temporarily shifted in light absorption in the light-sensitive element.

A coloring material particularly useful in the present invention is a negative working DRR compound which undergoes oxidation under an alkaline condition to release a dye. Other examples of coloring materials which can be used in the present inventon include a coupler which releases a diffusive dye as described in U.S. Pat. No. 3,227,550, and a dye developing agent.

The photographic emulsion to be used in the present invention may comprise as silver halide any one of silver bromide, silver iodobromide, silver chlorobromide, sivler chloride, solver iodochlorobromide, or a mixture thereof. A preferred example of silver halide is silver bromide, silver iodobromide, or silver iodochlorobromide containing 20 mol % or less of iodide and 30 mol % or less of chloride. Particularly preferred among these silver halides is silver bromide.

The silver halide emulsion is preferably an internal latent image type in which a latent image is formed mainly inside the particulate silver halide. The silver halide emulsion is also preferably a direct reversal photographic emulsion which forms a direct positive image when used in combination with a nucleating agent.

An internal latent image type silver halide emulsion can be distinctly defined by the phenomenon that the maximum density attained when developed with an internal type developing solution is greater than that attained when developed with a surface type developing solution. A suitable internal latent image type emulsion in the present invention is such that the maximum density measured by oridnary photographic densitometry on the silver halide emulsion coated on a tranparent support which has been exposed to light for a fixed time of 0.01 to 1 second, and then developed with the undermentioned developing solution A (internal type developing solution) at a temperature of 20° C. for 3 minutes is at least 5 times greater than that obtained when the same silver halide emulsion coat has been exposed to light in the same manner, and then developed with the undermentioned developing solution B (surface type developing solution) at a temperature of 20° C. for 4 minutes.

| Developing solution A | |
|---|---|
| Hydroquinone | 15 g |
| Monomethyl-p-aminophenol sesquisulfate | 15 g |
| Sodium sufite | 50 g |
| Potassium bromide | 10 g |
| Sodium hydroxide | 25 g |
| Sodium thiosulfate | 20 g |
| Water to make | 1 l |

| Developing solution B | |
|---|---|
| p-Oxyphenylglycine | 10 g |
| Sodium carbonate | 100 g |
| Water to make | 1 l |

The internal latent image type silver halide emulsion to be used in the present invention may be a hydrophilic colloidal dispersion of silver chloride, silver bromide, silver chlorobromide, silver iodobromide, silver iodochlorobromide, or a mixture thereof. The halogen composition of the silver halide emulsion can be selected depending on the purpose of the light-sensitive material and the processing conditions of the light-sensitive material. A particularly preferred composition is silver bromide, silver iodobromide, or silver iodochlorobromide containing 10 mol % or less of iodide and 30 mol % or less of chloride. Specific examples of such a silver halide emulsion inlcude emulsions as described in U.S. Pat. No. 2,592,250, conversion type emulsions as described in British Pat. No. 1,027,146, and U.S. Pat. Nos. 3,206,313, 3,511,662, 3,447,927, 3,737,313, 3,761,276, and 3,935,014, core/shell type emulsions, and emulsions doped with foreign metals. However, the present invention is not limited to these emulsions.

The present photographic element may comprise various photographic supports as described, e.g., in *Research Disclosure*, No. 17643 (1978).

If the photographic element of the present invention is an image-receiving material or a film unit, the image-receiving element in the photographic element comprises at least a mordant layer (image-receiving layer). Such a mordant layer preferably comprises a polymer mordant. As such a polymer mordant there can be used a polymer containing a secondary or tertiary amino group, a polymer containing a nitrogen-containing heterocyclic portion, or a polymer containing a quarternary cationic group thereof. Such a polymer preferably has a molecular weight of 5,000 or more, particularly 10,000 or more.

Specific examples of such a mordant include vinylpyridine polymers and vinylpyridinium cation polymers as disclosed in U.S. Pat. Nos. 2,548,564, 2,484,430, 3,148,061, and 3,756,814, vinylimidazolium cation polymers as disclosed in U.S. Pat. No. 4,123,386, polymer mordants crosslinkable with gelatin or the like as disclosed in U.S. Pat. Nos. 3,625,694, 3,859,096, and 4,128,538, and British Pat. No. 1,277,453, aqueous sol type mordants as disclosed in U.S. Pat. Nos. 3,958,995, 2,721,852, and 2,798,063, and Japanese Patent Application (OPI) Nos. 115228/79, 145529.79, 126027/79, 155835/79, and 17352/81, water-insoluble mordants as disclosed in U.S. Pat. No. 3,898,088, reactive mordants capable of being covalently bonded to dyes as disclosed in U.S. Pat. Nos. 4,168,976, and 4,201,840, and mordants as disclosed in U.S. Pat. Nos. 3,709,690, 3,788,855, 3,642,482, 3,488,706, 3,557,066, 3,271,147, and 3,271,148, Japanese Patent Application (OPI) Nos. 30328/78, 155528/77, 125/78, 1024/78, and 107835/78, and British Pat. No. 2,064,802.

Other preferred examples of such a mordant include mordants as described in U.S. Pat. Nos. 2,675,316, and 2,882,156.

As an image-receiving layer which mordants an azo dye containing a chelating group there can be preferably used an image-receiving layer comprising transition metal ions and a polymer capable of immobilizing the transition metal ions incorporated in a mordant layer or an adjacent layer. Specific examples of such a polymer capable of immobilizing transition metal ions are described in Japanese Patent Application (OPI) Nos. 48210/80, and 129346/80, and U.S. Pat. Nos. 4,273,853, 4,282,305, 4,193,796, 4,288,511, and 4,241,163.

The processing composition for processing the light-sensitive material of the present invention preferably contains a base such as sodium hydroxide, potassium hydroxide, sodium carbonate, and sodium phosphate so that the pH value thereof is about 9 or more. The processing composition preferably has an alkalinity of pH 11.5 or more. The processing composition also may contain an oxidation inhibitor such as sodium sulfite, ascorbate, and piperidinohexose reductone or a silver ion cencentration adjustor such as potassium bromide. Alternatively, the present processing composition may contain a thickening compound such as hydroxyethyl cellulose, and sodium carboxymethyl cellulose.

The alkaline processing composition may contain a compound such as benzyl alcohol which serves to accelerate development or transfer of the dye. The present developing agent may be incorporated in the processing composition or may be at least partially incorporated in an appropriate layer (e.g. silver halide emulsion layer, coloring material-containing layer, intermediate layer, and image-receiving layer) in the light-sensitive material (or film unit).

Specific examples of such a developing agent include hydroquinone compounds such as hydroquinone, 2,5-dichlorohydroquinone, and 2-chlorohydroquinone, aminophenol compounds such as 4-aminophenol, N-methylaminophenol, 3-methyl-4-aminophenol, and 3,5-dibromoaminophenol, catechol compounds such as catechol, 4-cyclohexylcatechol, 3-methoxycatechol, and 4-(N-octadecylamino)catechol, phenylenediamine compounds such as N,N-diethyl-p-phenylenediamine, 3-methyl-N,N-diethyl-p-phenylenediamine, 3-methoxy-N-ethyl-N-ethoxy-p-phenylene-diamine, and N,N,N'N'-tetramethyl-p-phenylenediamine, and 3-pyrazolidone compounds such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-4-methyl-4-hydroxymethyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(m-chlorophenyl)-4-methyl-3-pyrazolidone, 1-(p-chlorophenyl)-4-methyl-3-pyrazolidone, 1-(m-chlorophenyl)-3-pyrazolidone, 1-(p-chlorophenyl)-3-pyrazolidone, 1-(p-tolyl)-4-methyl-3-pyrazolidone, 1-(o-tolyl)-4-methyl-3-pyrazolidone, 1-(p-tolyl)-3-pyrazolidone, 1-(m-tolyl)-4,4-dimethyl-3-pyrazolidone, 1-(2-trifluoroethyl)-4,4-dimethyl-3-pyrazolidone, and 5-methyl-3-pyrazolidone. Particularly preferred among these compounds are 3-pyrazolidone compounds.

These developing agents may be used in combination as disclosed in U.S. Pat. No. 3,039,869.

The present invention will be further illustrated in the following examples, but the present invention should not be construed as being limited thereto.

EXAMPLE 1

Cover sheet

A comparative cover sheet (i) was prepared by coating the undermentioned layers (1) to (3) on a polyethyleneterephthalate transparent support in the following order.

(1) A neutralizing layer prepared by coating on a support 11 g/m$^2$ of a copolymer of an average molecular weight of 50,000 of acrylic acid and butyl acrylate (weight ratio 8/2) and 0.22 g/m$^2$ of 1,4-bis(2,3-epoxypropane)-butane.

(2) A layer comprising 4.5 g/m$^2$ of cellulose acetate of an acetylation degree of 51.0% and a methylvinyl ethermaleic monomethyl ester alternating copolymer (weight ratio 95/5) and 2.6 mmol/m$^2$ of 5-(2-cyano-1-methylthio)-1-phenyltetrazole.

(3) A 2-μm thick layer comprising a coat of a 6:4 (solid content) mixture of a 49.7/42.3/3/5 (weight ratio) latex copolymer of styrene-n-butylacrylate-acrylic acid-N-methylol acrylamide and a 93/4/3 (weight ratio) latex copolymer of methylmethacrylate-acrylic acid-N-methylol acrylamide.

A comparative cover sheet (ii) was prepared by coating the undermentioned layers (1) to (4) on a polyethyleneterephthalate transparent support.

(1) A neutralizing layer prepared by coating on a support 10 g/m$^2$ of a compolymer of an average molecular weight of 50,000 of acrylic acid-butyl acrylate (weight ratio 8/2) and 0.2 g/m$^2$ of 1,4-bis(2,3-epoxypropane)-butane.

(2) A 2nd timing layer prepared by coatiing on a support 7.5 g/m$^2$ of a 95/5 (weight ratio) mixture of a cellulose acetate of an acetylation degree of 51.0% and a methylvinylether-maleic monomethylester alternating copolymer.

(3) An auxiliary neutralizing layer comprising 1.05 g/m$^2$ of a methylvinylether-maleic anhydride alternating copolymer and 0.98 mmol/m$^2$ of 5-(2-cyano-1-methylthio)-1-phenyltetrazole.

(4) A 1st 2-μm thick timing layer comprising a coat of a 6:4 (solid content ratio) mixture of a 49.7/42.3/3/5 (weight ratio) latex compolymer of styrene-n-butylacrylateacrylic acid-N-methylolacrylamide and a 93/4/3 (weight ratio) latex compolymer of methylmethacrylate-acrylic acid-N-methylolacrylamide.

Cover sheets (iii) to (vi) of the present invention were prepared in the same manner as in the cover sheet (ii) except in that cellulose acetates having acetylation degrees shown in Table 1 were added to the auxiliary neutralizing layer of the comparative cover sheet (ii).

TABLE 1

| Cover sheet No. | Acetylation degree | Added amount ($g/m^2$) |
|---|---|---|
| (iii) | 55 | 0.15 |
| (iv) | " | 0.45 |
| (v) | " | 0.90 |
| (vi) | 51 | 0.45 |

LIGHT-SENSITIVE SHEET

A light-sensitive sheet was prepared by coating the undermentioned layers on a polyethyleneterephthalate transparent support.

(1) A mordant layer containing 3.0 $g/m^2$ of gelatin, and 3.0 $g/m^2$ of the following polymer latex mordant:

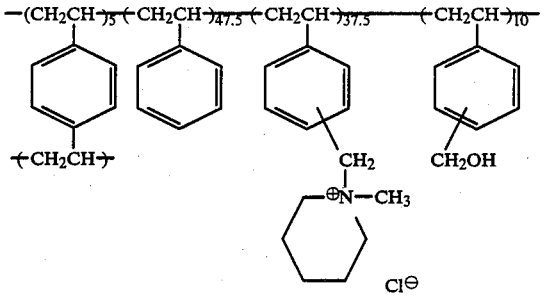

(2) A white reflecting layer containing 18 $g/m^2$ of titanium dioxide, and 2.0 $g/m^2$ of gelatin.

(3) A light screen layer containing 2.0 $g/m^2$ of carbon black and 1.0 g of gelatin.

(4) A layer containing 0.44 $g/m^2$ of the undermentioned cyan dye-releasing redox compound, 0.09 $g/m^2$ of tricylohexyl phosphate, 0.008 $g/m^2$ of 2,5-di-t-pentadecylhydroquinone, and 0.08 $g/m^2$ of gelatin.

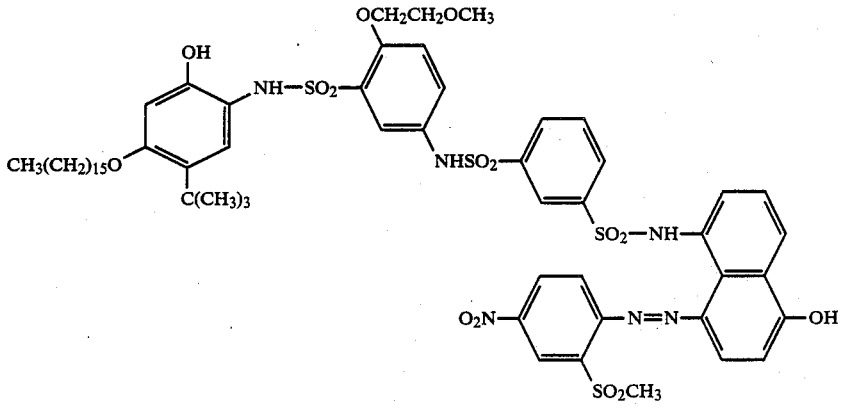

(5) A red-sensitive emulsion layer containing 1.03 $g/m^2$ (in terms of silver) of an internal latent image type red-sensitive direct positive silver bromide emulsion, 1.2 $g/m^2$ of gelatin, 0.04 $mg/m^2$ of the undermentioned nucleating agent, 0.13 $g/m^2$ of sodium salt of 2-sulfo-5-n-pentadecylhydroquinone.

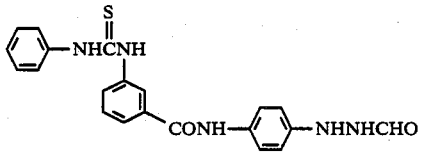

(6) A layer containing 0.43 $g/m^2$ of 2,5-di-t-pentadecylhydroquinone, 0.1 $g/m^2$ of trihexylphosphate, and 0.4 $g/m^2$ of gelatin.

(7) A layer containing 0.40 $g/m^2$ of a magenta dye-releasing redox compound of the undermentioned structural formula, 0.08 $g/m^2$ of tricyclohexylphosphate, and 0.9 $g/m^2$ of gelatin.

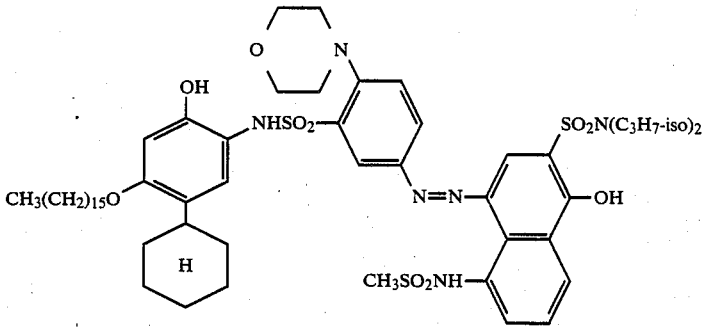

(8) A green-sensitive emulsion layer containing 0.82 g/m$^2$ (in terms of silver) of an internal latent image type green-sensitive direct positive silver bromide emulsion, 0.9 g/m$^2$ of gelatin, 0.3 mg/m$^2$ of the same nucleating agent as used in the layer (5), and 0.08 g/m$^2$ of sodium salt of 2-sulfo-5-n-pentadecylhydroquinone.

(9) Same as the layer (6)

(10) A layer containing 0.53 g/m$^2$ of a yellow dye-releasing redox compound of the undermentioned structural formula, 0.13 g/m$^2$ of tricyclohexylphosphate, and 0.7 g/m$^2$ of gelatin.

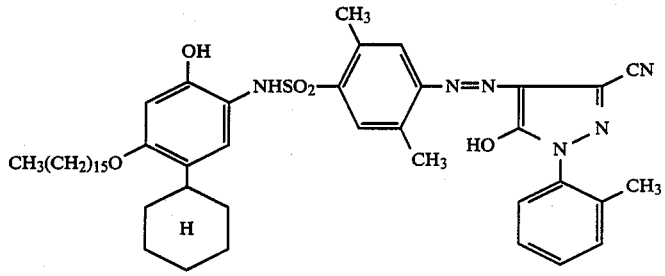

(11) A blue-sensitive emulsion layer containing 1.09 g/m$^2$ (in terms of silver) of an internal latent image type blue-sensitive direct positive silver bromide emulsion, 1.1 g/m$^2$ of gelatin, 0.04 g/m$^2$ of the same nucleating agent as used in the layer (5), and 0.07 g/m$^2$ of sodium salt of 2-sulfo-5-n-pentadecylhydroquinone.

(12) A layer containing 1.0 g/m$^2$ of gelatin.

The light-sensitive sheet thus prepared was exposed to light through a color test chart. The above described inventive cover sheets (iii to vi) and comparative cover sheets (i, ii) were each laminated on a thus exposed light-sensitive sheet. The undermentioned processing solution was then spread evenly to a thickness of 85 μm through the gap of the laminations by means of a pressure roller at a temperature of 25° C.

| Processing solution | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydride) | 0.2 g |
| Sodium salt of carboxymethyl cellulose | 58 g |
| Sodium hydroxide (28% aqueous solution) | 200 cc |
| Benzeyl alcohol | 1.5 cc |
| Carbon black | 150 g |
| Water | 685 cc |

After one hour passed, the red, green, and blue densities of the image thus formed were measured. The light-sensitive materials were then stored in a dark place at room temperature for 14 days. The image densities of the light-sensitive materials were again measured. Taking the difference $\Delta D_{max}$ between the maximum density ($D_{max}$) after 14-day storage and after 1-hour storage as the measure of aftertransfer, the results shown in Table 2 were obtained. A smaller $\Delta D_{max}$ in Table 2 corresponds to a smaller aftertransfer.

The above described light-sensitive sheets were exposed to light through a fine line test chart for sharpness evaluation. The above described comparative cover sheets (i, ii) and the inventive cover sheets (iii to vi) were each laminated on the thus exposed light-sensitive sheets. The above described processing solution was then spread evenly to a thickness of 85 μm through the gap of the laminations at a temperature of 25° C. After being allowed to stand for 1 day, the light-sensitive materials were measured for sharpness through a green filter by means of a microdensitometer. The spatial frequency at which C.T.F. (Contrast Transfer Function) is 0.5 was determined. The results are shown in Table 2. In Table 2, greater spatial frequency corresponds to better sharpness.

TABLE 2

| | Aftertransfer: $\Delta D_{max}$ (between 1 hr and 14 days) | | | |
|---|---|---|---|---|
| Cover sheet No. | B | G | R | Sharpness* |
| i (Comparison) | 0.15 | 0.35 | 0.18 | 2.61 |
| ii (Comparison) | 0.08 | 0.16 | 0.12 | 2.92 |
| iii (Invention) | 0.07 | 0.16 | 0.12 | 2.90 |
| iv (Invention) | 0.06 | 0.15 | 0.11 | 2.89 |
| v (Invention) | 0.05 | 0.13 | 0.10 | 2.89 |
| vi (Invention) | 0.08 | 0.16 | 0.12 | 2.91 |

*Spatial frequency at which C.T.F. is 0.5

Table 2 shows that the cover sheets comprising the 1st timing layer, the auxiliary neutralizing layer, the 2nd timing layer, and the neutralizing layer (comparative (ii) and present invention (iii to vi) have remarkably improved sharpness and aftertransfer characteristics as compared to the conventional cover sheet (comparative (i)). Furthermore, as shown in the present cover sheets (iii to vi), the adition of cellulose acetate to the auxiliary neutralizing layer causes little change in sharpness and aftertransfer characteristics as compared to the comparative cover sheet (ii).

EXAMPLE 2

The specimens which had been measured for aftertransfer in Example 1 were stored in a dark place at a temperture of 60° C. and a relative humidity of 70% for 2 weeks and 3 weeks. The specimens were then measured for image density in the same manner as in Example 1. The change in the maximum green density $D_{max}{}^G$ from that after 1-hour storage, $\Delta D_{max}{}^G$, was taken as the measure of image preservability. A positive value of $\Delta D_{max}{}^G$ means that the color has been intensified and a negative value of $\Delta D_{max}{}^G$ means that the color has been discolored. The less the absolute value of $\Delta D_{max}{}^G$ is, i.e., the less the change in $D_{max}$ from 1-hour storage is, the better is the image preservability. The results are shown in Table 3.

TABLE 3

| | $\Delta D_{max}{}^G$ | |
|---|---|---|
| Cover sheet No | between 1-hour and 2-week | between 1-hour and 3-week |
| i (Comparison) | +0.10 | +0.05 |
| ii (Comparison) | −0.12 | −0.17 |
| iii (Invention) | −0.08 | −0.13 |
| iv (Invention) | ±0 | −0.02 |

TABLE 3-continued

| Cover sheet No | $\Delta D_{max}{}^{G}$ between 1-hour and 2-week | $\Delta D_{max}{}^{G}$ between 1-hour and 3-week |
|---|---|---|
| v (Invention) | +0.05 | +0.03 |
| vi (Invention) | −0.10 | −0.13 |

Table 3 shows that the comparative cover sheet (i) has great color intensification change from 1-hour storage and the comparative cover sheet (ii) has great discoloration change from 1-hour storage, while the color present cover sheets (iii) to (vi) have small $\Delta D_{max}{}^{G}$ both in intensification and discoloration from 1-hour storage and small discoloration changes from 2-week storage and 3-week storage, i.e. excellent image preservability.

From the results in Examples 1 and 2, it can be concluded that the present neutralizing system (cover sheet) can provide improvements in sharpness and aftertransfer characteristics and an excellent image preservability.

The present color diffusion transfer photographic element can provide a transfer image excellent in sharpness and with less aftertransfer and an excellent preservability of the transfer image thus obtained.

While the invention has been described in detail and with reference to specific embodiments thereof, it will be apparent to one skilled in the art that various changes and modifications can be made therein without departing from the spirit and scope thereof.

What is claimed is:

1. A photographic element comprised of a light-sensitive dye release sheet comprising silver halide and dye release compounds capable of releasing dye in the presence of an alkaline processing solution and stop development at a first pH determined by a neutralization system defined below, a receiving sheet and a cover sheet, wherein development, dye release and dye transfer occur in the presence of an alkaline processing solution, and wherein said cover sheet is provided with a neutralizing system which causes neutralization by an alkaline processing solution to proceed by at least a first and a second stage, wherein the first stage is characterized in that neutralization (lowering) of the pH of an alkaline processing solution occurs to the extent to interrupt development and dye release reactions but at which the transfer of a dye for forming a transfer image can continue, and a second stage at which the pH of the processing solution is gradually lowered to a final value at which the transfer of a dye for forming a transfer image is inhibited and which is stably maintained over prolonged storage, said photographic element characterized in that the neutralizing system comprises at least a neutralizing layer, a second neutralization timing layer, an auxiliary neutralizing layer and a first neutralization timing layer as viewed from the support side, and that said auxiliary neutralizing layer contains from 5 to 60% by weight of a cellulose acetate having an acetylation degree of 40 to 60.

2. A photographic element as claimed in claim 1, wherein said neutralizing system comprises an acidic material containing an acidic group of a pKa of 9 or less or a precursor group providing such an acidic group upon hydrolysis.

3. A photographic element for use in color diffusion transfer photography, comprising a support having provided thereon a neutralizing system, wherein said neutralizing system consists of at least a neutralizing layer, a second neutralization timing layer, an auxiliary neutralizing layer, and a first neutralization timing layer as viewed from the support side and wherein said auxiliary neutralizing layer contains from 5 to 60% by weight of a cellulose acetate having an acetylation degree of 40 to 60.

4. A photographic element as in claim 3, wherein the degree of acetylation of the cellulose acetate in the auxiliary neutralizing layer is from 50 to 56.

5. A photographic element as in claim 3, wherein said auxiliary neutralizing layer is further comprised of an acidic material containing an acetic group of a pKa of 9 or less or a precursor group providing such an acetic group upon hydrolysis.

6. A photographic element as in claim 3, wherein said acidic material is selected from the group consisting of a higher aliphatic acid, and polymers of acrylic acid, methacrylic acid or maleic acid.

7. A photographic element as in claim 6, wherein said acidic material is selected from the group consisting of copolymers of vinyl monomers selected from the group consisting of ethylene, vinyl acetate, and vinyl methylether with maleic anhydride or n-butyl half esters thereof, copolymers of butyl acrylate with acrylic acid, and cellulose acetate hydrogen phthalate.

8. A photographic element as in claim 3, wherein the cellulose acetate in the auxiliary neutralizing layer is present in an amount of from 5 to 60% by weight based on the total weight of polymer in the auxiliary neutralizing layer.

9. A photographic element as in claim 3, wherein the proportion of the cellulose acetate in the auxiliary neutralizing layer is from 10 to 60% by weight of the total weight of the polymer in the auxiliary neutralizing layer.

10. A photographic element as in claim 3, wherein the amount of auxiliary neutralizing layer is in the range of from 0.5 to 5.0 g/m$^2$.

11. A photographic element as in claim 3, further comprising a color diffusion transfer dye release sheet comprising silver halide and dye release compounds capable of releasing dye in the presence of an alkaline processing solution.

12. A photographic element as in claim 3, wherein said acidic material is selected from the group consisting of copolymers of acrylic acid, methacrylic acid and maleic acid and partial esters and anhydrides thereof.

13. A photographic element as in claim 3, wherein said acidic material is a copolymer of acrylic acid with acrylic acid ester.

14. A photographic element as in claim 3, wherein said acidic material is a latex-type acidic polymer.

* * * * *